US005987289A

United States Patent [19]

Kawahara

[11] Patent Number: 5,987,289

[45] Date of Patent: Nov. 16, 1999

[54] DEVELOPING DEVICE FOR AN IMAGE FORMING APPARATUS

[75] Inventor: Ichiro Kawahara, Niigata, Japan

[73] Assignee: NEC Corporation, Japan

[21] Appl. No.: 09/201,255

[22] Filed: Nov. 30, 1998

[30] Foreign Application Priority Data

Nov. 28, 1997 [JP] Japan ..... 9-328539

[51] Int. Cl.[6] ..... G03G 15/08

[52] U.S. Cl. ..... 399/279; 492/56

[58] Field of Search ..... 399/279, 281, 399/286, 265, 248; 492/18, 28, 53, 56; 29/895; 428/909

[56] References Cited

U.S. PATENT DOCUMENTS

| | | | |
|---|---|---|---|
| 4,299,902 | 11/1981 | Soma et al. | 399/248 X |
| 4,317,270 | 3/1982 | Watanabe et al. | 492/53 X |
| 5,012,289 | 4/1991 | Aldrich et al. | 399/279 X |
| 5,467,178 | 11/1995 | Mui et al. | 492/56 X |

FOREIGN PATENT DOCUMENTS

| | | |
|---|---|---|
| 62-118372 | 5/1987 | Japan . |
| 63-189876 | 8/1988 | Japan . |
| 2-3078 | 1/1990 | Japan . |
| 3-179369 | 8/1991 | Japan . |
| 4-75073 | 3/1992 | Japan . |

*Primary Examiner*—Matthew S. Smith
*Assistant Examiner*—Sophia S. Chen
*Attorney, Agent, or Firm*—Ostrolenk, Faber, Gerb & Soffen, LLP

[57] ABSTRACT

A developing device including a developing roller and applicable to an electrophotographic image forming apparatus is disclosed. The developing roller is made up of a flexible member and a shaft and feeds toner to a latent image formed on a photoconductive element. A supply roller supplies the toner to the developing roller. A gap is formed between the flexible member and the shaft at at least one end portion of a printing region assigned to the developing roller. The gap sets up a uniform pressure between the supply roller and the developing roller and between the developing roller and the photoconductive element.

5 Claims, 7 Drawing Sheets

DEVELOPING DEVICE FOR AN IMAGE FORMING APPARATUS

BACKGROUND OF THE INVENTION

The present invention relates to a developing device for use in a printer, facsimile apparatus, copier or similar electrophotographic image forming apparatus and more particularly to an improved developing roller included in the developing device.

An electrophotographic image forming apparatus extensively used today includes a developing device for developing a latent image formed on an image carrier with toner. The developing device includes a developing roller for depositing the toner on the image carrier and a supply roller for supplying the developer from a hopper to the developing roller, as taught in, e.g., Japanese Patent Laid-Open Publication Nos. 63-189876 and 62-118372. The conventional developing roller includes a flexible member implemented by a single layer of urethane rubber or silicone rubber. Japanese Patent Laid-Open Publication No. 3-179369 discloses a developing roller including a porous flexible member whose hardness is less than 50°, as measured by an Ascar C hardness gauge.

However, the problem with the conventional developing devices is that the toner transfer from the supply roller to the developing roller differs from the opposite end portions to the intermediate portion. Such irregular toner transfer brings about various defective images including a black solid image with short density, a locally omitted image, and a mesh image with an irregular density distribution.

Technologies relating to the present invention are also disclosed in, e.g, Japanese Patent Laid-Open Publication Nos. 2-3078 and 4-75073.

SUMMARY OF THE INVENTION

It is therefore an object of the present invention to provide a developing device for an image forming apparatus capable of insuring stable feed of toner to an image carrier.

It is another object of the present invention to provide a developing device for an image forming apparatus capable of feeding toner uniformly from a supply roller to a developing roller to thereby allow the developing roller to deposit the toner on an image carrier in a uniform distribution.

It is still another object of the present invention to provide a developing device for an image forming apparatus capable of preventing the end portions of a supply roller and those of a developing roller from being deteriorated, and preventing the end portions of an image carrier from being locally shaved off.

A developing device for developing a latent image formed on an image carrier of the present invention includes a developing roller made up of a flexible member and a shaft for feeding toner to a latent image formed on a photoconductive element. A supply roller supplies the toner to the developing roller. A gap is formed between the flexible member and the shaft at at least one end portion of a printing region assigned to the developing roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, brief reference will be made to a conventional developing roller included in a developing device, shown in FIG. 1A. As shown, the developing roller, labeled 102, is made up of a shaft 22 and a conductive or semiconductive elastic member 21 adhered to the shaft 22. The developing roller 102 does not have any step at its bearing portions and is taught in Japanese Patent Laid-Open Publication No. 63-189876 mentioned earlier.

Figure 1A:
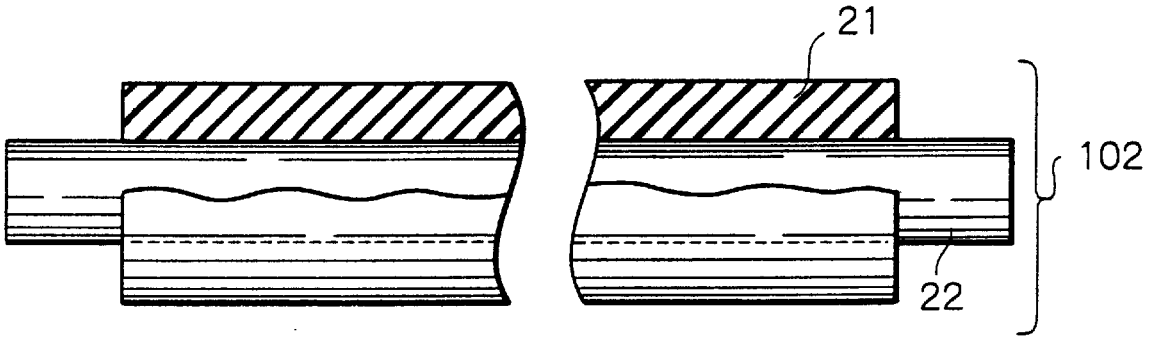
Fig. 1A PRIOR ART
FIGS. 1A and 1B are sections each showing a particular conventional developing roller.
Figure 1B:
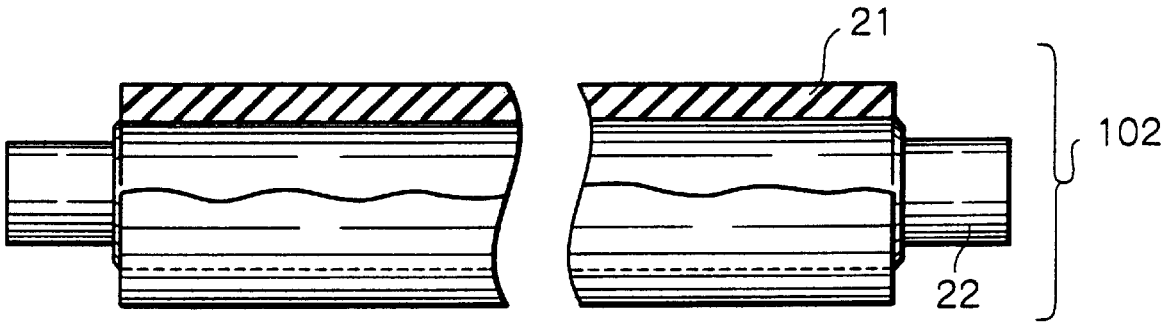
Fig. 1B PRIOR ART

FIG. 1B shows another conventional developing roller 102 similar to the developing roller 102 of FIG. 1A except that the conductive or semiconductor elastic member 21 is affixed to the shaft 22 by pressing, and that the roller 102 has steps at its bearing portions. This kind of developing roller is disclosed in Japanese Patent Laid-Open Publication No. 62-118372 also mentioned earlier.

In the developing rollers 102 shown in FIGS. 1A and 1B, the elastic member 21 is implemented as a single layer of urethane rubber or silicone rubber. The conventional developing rollers 102 have some problems left unsolved, as stated previously.

Figure 2:
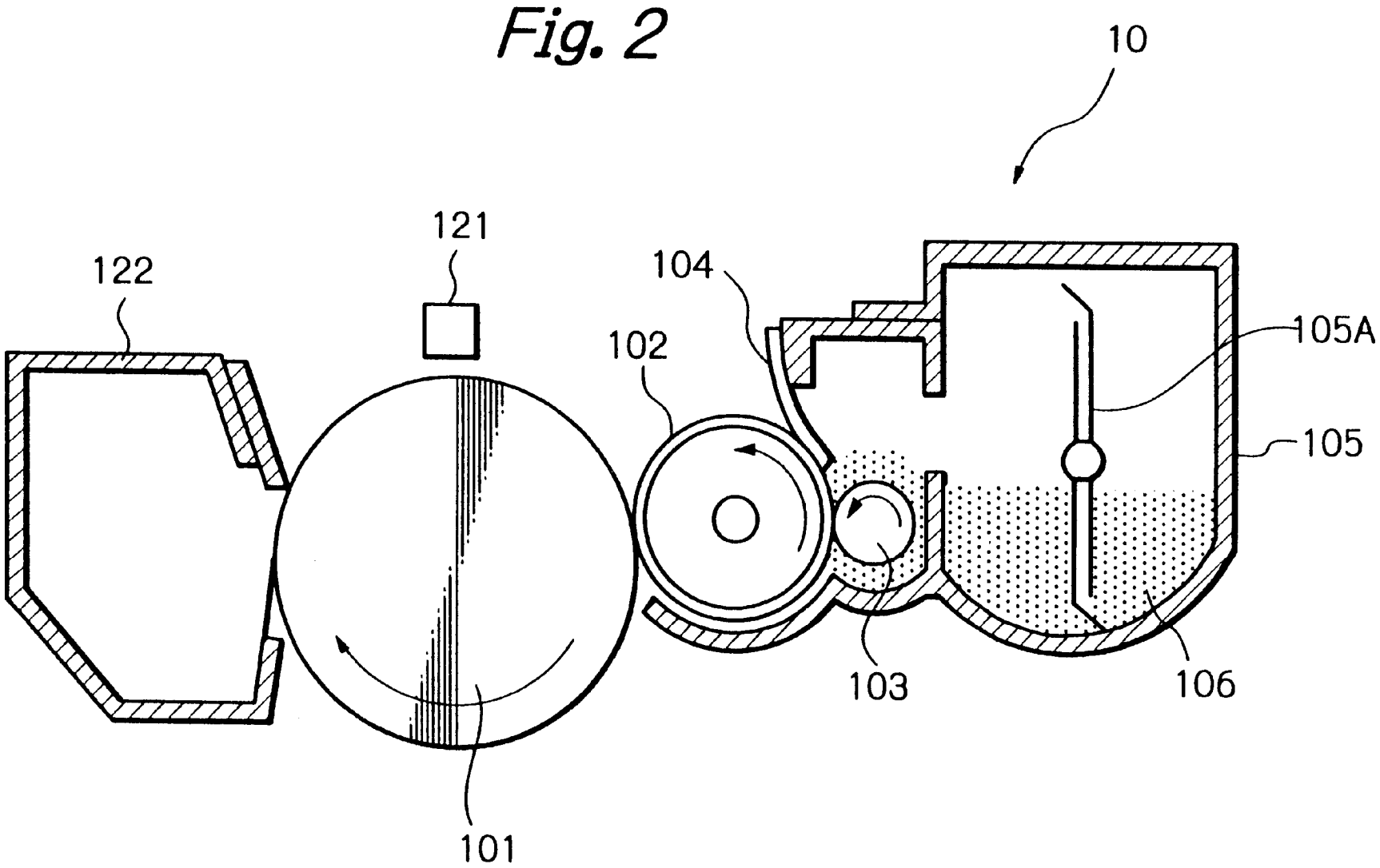
FIG. 2 is a section showing an image forming apparatus to which a first embodiment of the developing device in accordance with the present invention is applied.

Referring to FIG. 2, an image forming apparatus to which a first embodiment of the developing device in accordance with the present invention is applicable is shown. As shown, the image forming apparatus includes a photoconductive element or image carrier in the from of a drum 101. A charger 121 uniformly charges the surface of the drum 101 in order to allow a latent image to be electrostically formed on the drum 101. A developing device 10 embodying the present invention develops the latent image formed on the drum 101 with toner 106. A waste toner collecting device 122 collects waste toner therein.

The developing device 10 includes a developing roller 102, a supply roller 103 for supplying the toner 106 to the developing roller 102, a hopper 105 for feeding a preselected amount of toner 106 to the supply roller 103, a regulating member 104 for causing the toner supplied from the supply roller 103 to the developing roller 102 to form a thin uniform layer or film on the roller 102, and an agitator 105A. The supply roller 103 is made up of a shaft formed of stainless steel, aluminum or similar metal, a porous elastic material covering the shaft. The porous elastic material is implemented by, e.g., conductive or insulative sponge-like silicon or urethane having eighty to 150 cells for an inch.

Figure 3:
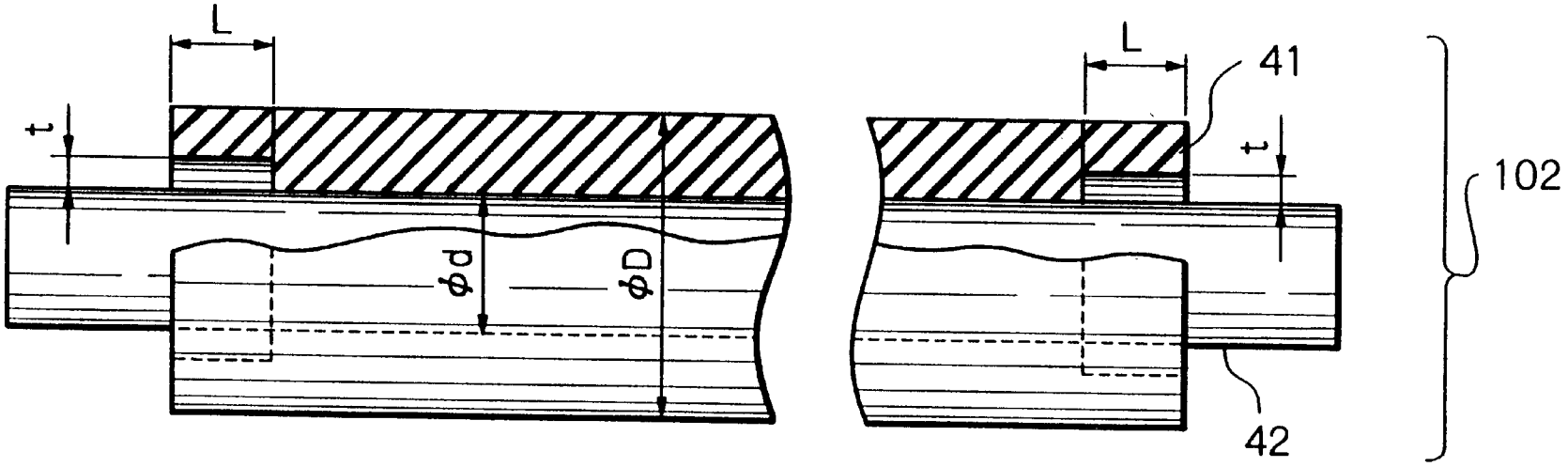
FIG. 3 is a fragmentary section showing a developing roller included in the first embodiment.

Specifically, as shown in FIG. 3, the developing roller 102 has a shaft 42 formed of stainless steel, aluminum or similar metal, and an elastic member 41 affixed to the periphery of the shaft 42 by adhesion or pressing. The elastic member 41 is formed of, e.g., silicone, urethane or similar elastic material provided with conductivity, or conductive or insulative sponge-like silicone, urethane or similar porous material having eighty to 150 cells for an inch. The sponge-like porous material has a hardness of less than 50° inclusive, as measured by an Ascar C hardness gauge. The shaft 42 is spaced from the elastic member 41 at axially opposite end portions thereof by gaps, as illustrated. Assume that the gaps each has a radial size of t and an axial size of L, that the developing roller 102 has an outside diameter of D, and that the shaft 42 has an outside diameter of d. Then, the radial dimension t and axial dimension L of each gap should preferably be (D−d)×0.025 or above and 1 mm or above, respectively.

In operation, the toner 106 is stored in the hopper 105 located to face the drum 101 and is agitated by the agitator 105A. The supply roller 103 rotating counterclockwise, as viewed in FIG. 2, supplies the toner 106 from the hopper 105 to the developing roller 102 also rotating counterclockwise, as viewed in FIG. 2. The transfer of the toner 106 from the supply roller 103 to the developing roller 102 is effected by a pressure acting between the rollers 103 and 102. The toner is therefore physically pressed against the developing roller 102, forming a thin film on the roller 102.

Figure 4:
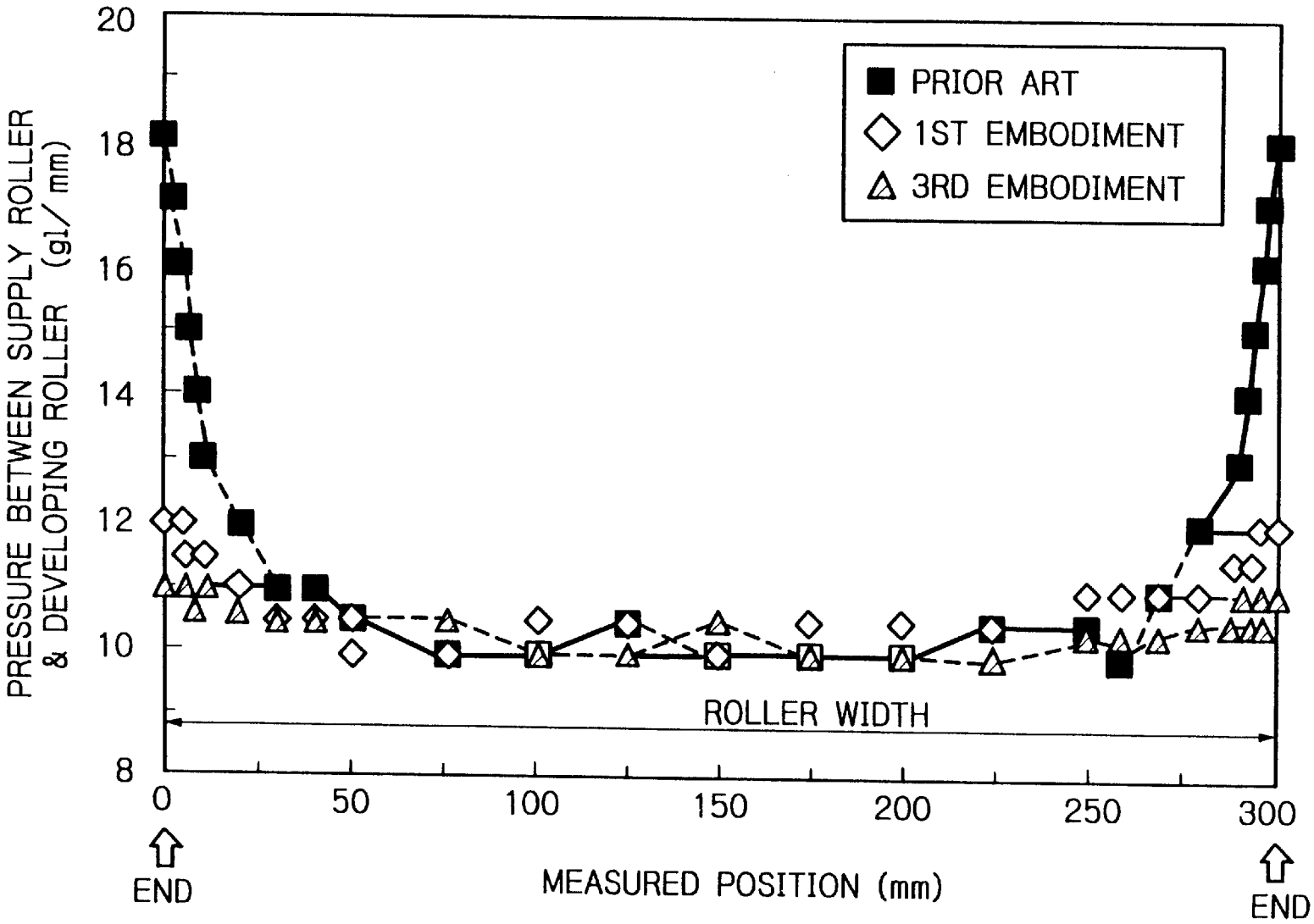
FIG. 4 is a graph comparing the present invention and prior art with respect to a pressure distribution between a supply roller and a developing roller.

The gaps between the elastic member 41 and the shaft 42, FIG. 3, are positioned at both ends of the range over which the developing roller 102 and supply roller 103 contact each other. Therefore, the end portions of the elastic member 41 absorb a pressure higher than a pressure acting on the intermediate portion of the elastic member 41 while the developing roller 102 is in rotation. As a result, a uniform pressure distribution shown in FIG. 4 is achievable. It follows that the illustrative embodiment insures the transfer of the toner from the supply roller 103 to the developing roller 102, desirable development to occur between the developing roller 102 and the drum 101, and the uniform deposition of the toner and charge on the developing roller 102 effected by the regulating member 104. Further, the uniform pressure acting on the entire developing roller 102 prevents the end portions of the feed roller 103 from being mechanically deteriorated due to repeated printing, prevents the developing roller 102 from being locally shaved off, and prevents even the end portions of the drum 101 from being locally shaved off. The illustrative embodiment is therefore successful to preserve high image quality over a long period of time.

Generally, a supply roller and a developing roller are rotated counterclockwise by a drive source with their axes spaced from each other by a preselected distance. The opposite ends of the developing roller are supported by bearings not shown. Therefore, the developing roller is not deformed at the opposite ends, but is deformed at the intermediate portion. As a result, the pressure acting between the developing roller and the supply roller decreases at the intermediate portion. This, coupled with the fact that the rollers each is originally greater in diameter at the opposite ends than at the center for machining reasons, causes a higher pressure to act at the opposite ends than at the center between the rollers. In the illustrative embodiment, the gaps between the elastic member 41 and the shaft 42 allow the elastic member 41 to yield at the opposite end portions while the developing roller 102 is in rotation in contact with the supply roller 103. This allows a uniform pressure to act between the two rollers 102 and 103 in the axial direction and thereby insures uniform toner transfer.

In another conventional arrangement, a developing roller and a photoconductive drum or image carrier slidingly rotate on each other with their axes spaced by a variable distance from each other. In this case, too, the developing roller and a supply roller each has a greater diameter at opposite ends than at the center for machining reasons. This, coupled with the deformation of the intermediate portion of the developing roller, results in an undesirable pressure distribution between the developing roller and the supply roller, as shown in FIG. 4; the pressure is higher at opposite end portions than at the intermediate portion. The above embodiment is also successful to solve this problem.

Figure 5:
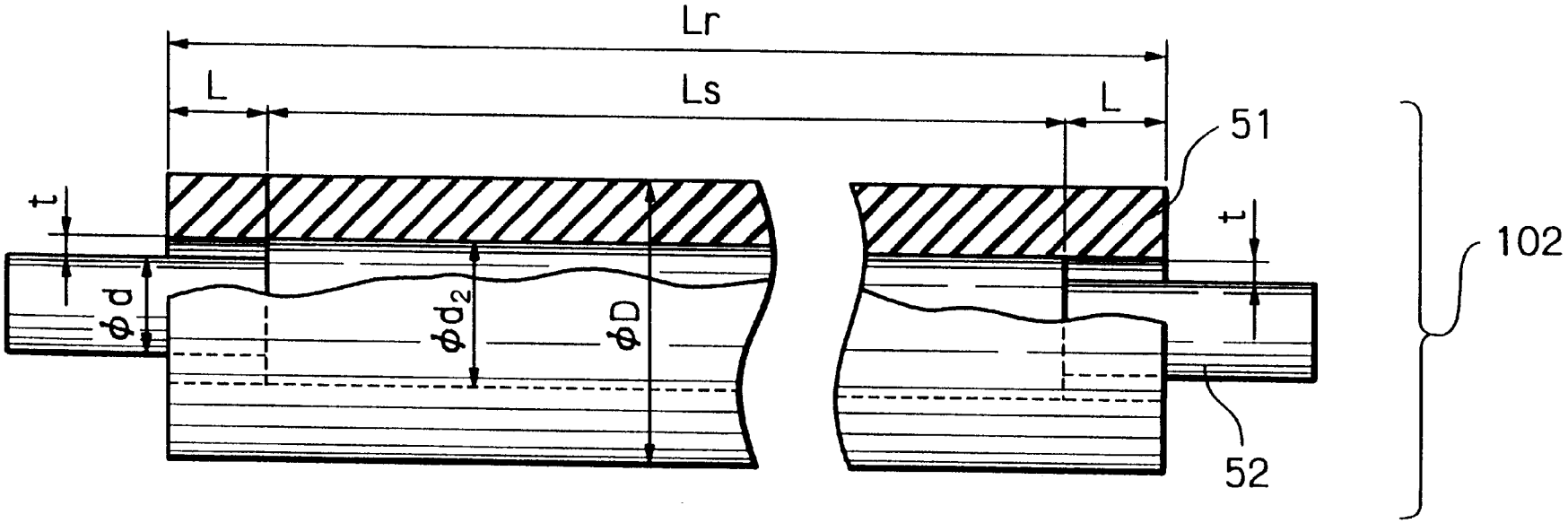
FIG. 5 is a section showing a developing roller representative of a second embodiment of the present invention.

FIG. 5 shows a developing roller representative of a second embodiment of the present invention. As shown, the developing roller, also labeled 102, includes a shaft 52 which is stepped at both ends in order to implement the gaps. Again, assume that the gaps each has a radial dimension of t and an axial dimension of L, and that the developing roller has an outside diameter of D. In addition, assume that the shaft 52 has an outside diameter of $d_1$ at its bearing portions and an outside diameter of $d_2$ at its portion contacting a flexible member 51 ($d_2>d_1$), that the elastic member 51 has an axial dimension or length of Lr, and that the portion of the developing roller having the outside diameter $d_2$ has a dimension or length of Ls. Then, the dimension t is determined by ($d_1-d_2$) while the dimension L is determined by (Lr−Ls)/2. Preferably, the dimension t is greater than ($D-d_1$)×0.025 inclusive while the dimension L is greater than (Lr−Ls)=1 mm inclusive. As for the rest of the configuration, the second embodiment is identical with the first embodiment.

In this embodiment, the accuracy of the gaps is determined by the outside diameters $d_1$ and $d_2$ of the shaft 52, the length Lr of the flexible member 51, and the length Ls of the shaft 52. Such an accuracy is easier to implement than the accuracy of the previous embodiment. This embodiment is therefore advantageous over the previous embodiment as to the uniform pressure to act between the developing roller 102 and the supply roller not shown. This is also true with the pressure to act between the developing roller 102 and the drum not shown.

Figure 6:
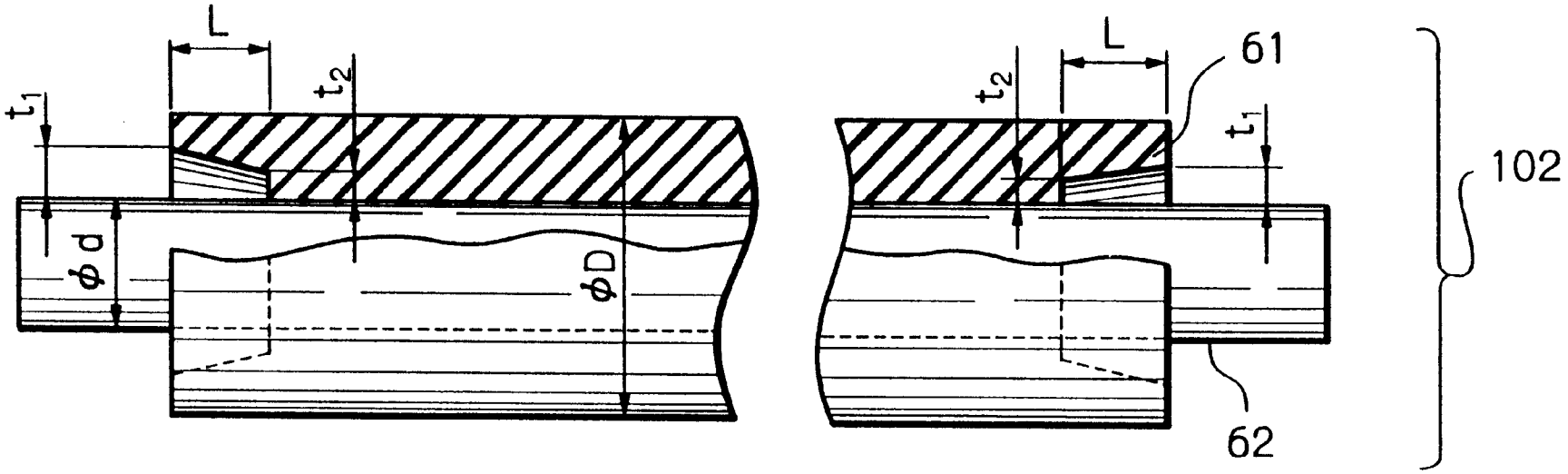
FIG. 6 is a section showing a developing roller representative of a third embodiment of the present invention.

A third embodiment of the developing device in accordance with the present invention will be described with FIG. 6. As shown, a developing roller, also labeled 102, is identical with the developing roller 102 of FIG. 3 except that the gaps between a flexible material 61 and a shaft 62 each is flared axially outward. The flared gaps each has a radial dimension of $t_1$ at the end of the developing roller 102 and has a radial dimension $t_2$at an intermediate portion ($t_1>t_2$). Assume that the developing roller has an outside diameter of D at its rubber portion, and that a shaft 62 has an outside diameter of d. Then, the dimension $t_2$ is selected to be greater than (D−d)×0.025 inclusive while the dimension L is selected to be greater than 1 mm inclusive.

The pressure acting between the developing roller 102 and the supply roller, not shown, is higher at the opposite end portion than at the intermediate portion, as discussed with reference to FIG. 4. Therefore, the flared gaps shown in FIG. 6 uniform the pressure distribution more than the gaps of the previous embodiments. This is also true with the pressure acting between the developing roller 102 and the drum not shown.

Specifically, FIG. 4 compare the first and second embodiments of the present invention and a conventional developing device. As shown, in the conventional developing device, a high pressure acts only on the opposite ends of a developing roller. By contrast, in each of the first and third embodiments, the gaps formed between the end portions of the flexible member and those of the shaft and extending over a necessary length, as shown in FIG. 4, allow the flexible member to yield during the rotation of the developing roller. As a result, a uniform pressure acts between the developing roller and the supply roller over the entire axial length and insures more even toner supply than in the conventional arrangement. Moreover, the uniform pressure prevents the developing roller from being locally shaved off and thereby insures high image quality over a long period of time. In addition, the toner deposited on the developing roller in the form of a thin film is transferred to the drum by the pressure acting between the developing roller 102 and the drum and a potential difference acting between them.

Figure 7:
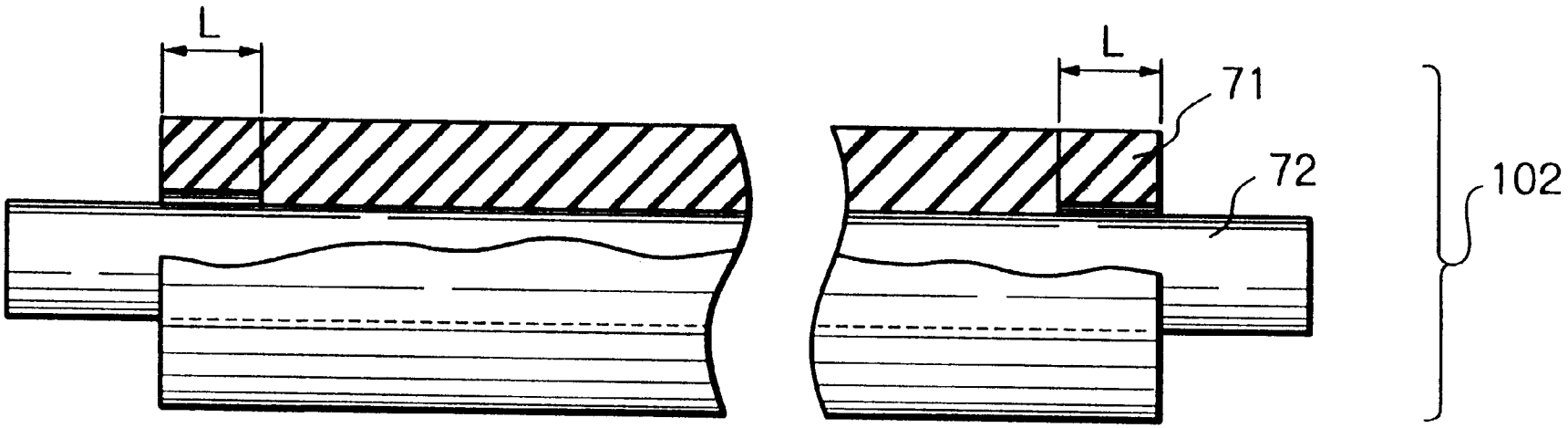
FIG. 7 is a section showing a developing roller representative of a fourth embodiment of the present invention.

FIG. 7 shows a developing roller representative of a fourth embodiment of the present invention. As shown, the developing roller, also labeled 102, is similar in configuration to the conventional developing roller of FIGS. 1A and 1B and made up of a flexible member 71 and a shaft 72. As shown, in the illustrative embodiment, the flexible member 71 and shaft 72 are not adhered to each other at the opposite end portions of the developing roller 102. As for the other materials and compositions, this embodiment is identical with the first embodiment.

In the configuration shown in FIG. 7, the absence of adhesive at the opposite end portions of the developing roller 102 implements the gaps of about 0.1 mm. With such gaps, it is also possible to cause a uniform pressure to act between the developing roller 102 and the supply roller, not shown, and between the developing roller 102 and the drum not shown.

In summary, it will be seen that the present invention provides a developing device capable of obviating defecting printing at opposite ends of a printing region ascribable to irregular pressure distributions between a supply roller and a developing roller and between the developing roller and a photoconductive element. This advantage is derived from unique gaps formed between a flexible member and a shaft constituting the developing roller.

Various modifications of the present invention will become possible for those skilled in the art after receiving the teachings of the present disclosure without departing from the scope thereof.

What is claimed is:

1. A developing device for developing a latent image electrostatically formed on a photoconductive element, comprising:

a developing roller comprising a flexible member and a shaft for feeding toner to the latent image formed on the photoconductive element, the flexible member surrounding said shaft and being exposed so as to receive toner thereon;

a supply roller for supplying the toner to said developing roller; and a gap formed between said flexible member and said shaft at least one end portion of a printing region assigned to said developing roller; said gap extending from a first point on said developing roller to a second point defining an end of the flexible member at the end portion whereby the gap is not closed off at the end.

2. A developing device as claimed in claim 1, wherein said gap has a dimension greater than, inclusive, a product of a difference between an outside diameter of said flexible member and a diameter of said shaft and a preselected value.

3. A developing device as claimed in claim 2, wherein said preselected value is between 0.015 and 0.035.

4. A developing device as claimed in claim 1, wherein said gap is flared outward in an axial direction of said developing roller.

5. A developing device as claimed in claim 1, wherein said gap comprises a stepped portion formed in either one of said flexible member and said shaft.

* * * * *